US010847090B2

(12) United States Patent
Rha et al.

(10) Patent No.: US 10,847,090 B2
(45) Date of Patent: Nov. 24, 2020

(54) ELECTROLUMINESCENT DISPLAY DEVICE AND DRIVING METHOD OF THE SAME

(71) Applicant: LG Display Co., Ltd., Seoul (KR)

(72) Inventors: Sunghoon Rha, Paju-si (KR); Changhoon Jeon, Paju-si (KR); Hyungguk Bae, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/178,380

(22) Filed: Nov. 1, 2018

(65) Prior Publication Data

US 2019/0147796 A1 May 16, 2019

(30) Foreign Application Priority Data

Nov. 10, 2017 (KR) ..... 10-2017-0149552

(51) Int. Cl.
*G09G 3/325* (2016.01)
*G09G 3/3291* (2016.01)
(Continued)

(52) U.S. Cl.
CPC ..... *G09G 3/325* (2013.01); *G09G 3/3233* (2013.01); *G09G 3/3266* (2013.01); *G09G 3/3291* (2013.01); *G09G 2300/0819* (2013.01); *G09G 2300/0861* (2013.01); *G09G 2310/0262* (2013.01); *G09G 2320/0204* (2013.01);
(Continued)

(58) Field of Classification Search
CPC ..... G09G 3/3233; G09G 2320/045; G09G 3/3266; G09G 2300/0426; G09G 3/3225; G09G 3/3283; G09G 3/3291; G09G 2300/043; G09G 2310/0251; G09G 2320/043; G09G 2320/0233; G09G 2320/0242; G09G 2320/0257
See application file for complete search history.

(56) References Cited

U.S. PATENT DOCUMENTS

2009/0201231 A1* 8/2009 Takahara ..... G09G 3/3233 345/76
2011/0122119 A1* 5/2011 Bae ..... G09G 3/3233 345/211
(Continued)

FOREIGN PATENT DOCUMENTS

KR 10-2017-0136110 A 12/2017

*Primary Examiner* — Gerald Johnson
(74) *Attorney, Agent, or Firm* — Seed IP Law Group LLP

(57) ABSTRACT

The electroluminescent display device according to the present disclosure comprises a plurality of pixels. Each of the plurality of pixels comprises a driving element for generating a driving current, a light emitting element for emitting light according to the driving current, an emission controlling element for controlling a flow of the driving current between the driving element and the light emitting element, and a switching circuit for setting a first gate-source voltage of the driving element corresponding to the driving current based on a first data voltage during a first period and setting a second gate-source voltage of the driving element based on a second data voltage different from the first data voltage during a second period following the first period, wherein the second gate-source voltage is different from the first gate-source voltage, and wherein during the second period the emission controlling element is turned off.

15 Claims, 13 Drawing Sheets

(51) Int. Cl.
*G09G 3/3266* (2016.01)
*G09G 3/3233* (2016.01)

(52) U.S. Cl.
CPC ..... *G09G 2320/0257* (2013.01); *G09G 2320/043* (2013.01); *G09G 2320/064* (2013.01)

(56) References Cited

U.S. PATENT DOCUMENTS

| | | | | |
|---|---|---|---|---|
| 2015/0123557 | A1* | 5/2015 | Lee | G09G 3/3233 315/228 |
| 2015/0170576 | A1* | 6/2015 | Bae | G09G 3/3266 345/205 |
| 2015/0187270 | A1 | 7/2015 | Lee et al. | |
| 2015/0364076 | A1* | 12/2015 | Park | G09G 3/2081 345/77 |
| 2018/0212016 | A1* | 7/2018 | Choi | G09G 3/3258 |
| 2019/0057646 | A1* | 2/2019 | Lin | G09G 3/3233 |
| 2020/0118487 | A1* | 4/2020 | Kim | G09G 3/3291 |

* cited by examiner

ELECTROLUMINESCENT DISPLAY DEVICE AND DRIVING METHOD OF THE SAME

CROSS-REFERENCE TO RELATED APPLICATION

This application claims the benefit of Korea Patent Application No. 10-2017-0149552 filed on Nov. 10, 2017, which is incorporated herein by reference for all purposes as if fully set forth herein.

BACKGROUND

Technical Field

The present document relates to an electroluminescent display device and a method for driving the electroluminescent display device.

Description of the Related Art

The electroluminescent display device is classified into an inorganic light emitting display device and an organic light emitting display device according to the material of a light emitting layer. The organic light emitting display device of an active matrix type includes an organic light emitting diode OLED which emits light itself, and has the advantages of high response speed, high luminous efficiency, high luminance and wide viewing angle.

The organic light emitting display device arranges the pixels each of which includes the OLED in a matrix form and adjusts the luminance of the pixels according to gradation of image data. Each pixel includes a driving TFT (Thin Film Transistor), which controls the driving current flowing through the OLED according to the voltage between a gate electrode and a source electrode, and one or more switching TFTs for programming the voltage between the gate electrode and the source electrode of the driving TFT, and adjusts the display luminance by emitting the OLED with a luminance proportional to the driving current.

The driving characteristics of the pixel such as the threshold voltage of the driving TFT must be the same in all the pixels, in order to realize uniform image quality without luminance and color difference between pixels. However, there may be a deviation in the driving characteristics between pixels due to a process variation. In addition, as the driving time of a display device elapses, the deterioration progress speeds of pixels become different from each other, and the differences in the driving characteristics between pixels may become large. Such a driving characteristic deviation can change the amount of driving current flowing to the OLED, resulting in image quality irregularity between pixels.

In order to improve the image quality and lifetime of a display device, an internal compensation circuit for compensating for the differences in driving characteristics between pixels is applied to the organic light emitting display device. The internal compensation circuit may be implemented inside the pixel. The organic light emitting display device uses the compensation circuits implemented in pixels, to sample the gate-source voltage of the driving TFT which varies according to the threshold voltage of the driving TFT and compensate for the variation of the threshold voltage of the driving TFT based on the sampled voltage.

BRIEF SUMMARY

The driving current determining the emitting luminescence of the OLED depends on the gate-source voltage of the driving TFT. The gate-source voltage of the driving TFT is updated every frame in accordance with the writing period of a data voltage. However, when same image is displayed on a pixel for a long time, a hysteresis phenomenon occurs because the gate-source voltage of the driving TFT included in the pixel does not change. Such the hysteresis phenomenon may induce a DC afterimage and lowers display quality. The longer the time during which the gate-source voltage of the driving TFT is maintained at a same value, the stronger the hysteresis phenomenon becomes.

Accordingly, an objective of the present disclosure is to provide the electroluminescent display device and the driving method for the same which can improve the hysteresis phenomenon of the driving TFT and enhance display quality.

The electroluminescent display device according to the present disclosure may comprise a plurality of pixels. Each of the plurality of pixels comprises a driving element for generating a driving current, a light emitting element for emitting light according to the driving current, an emission controlling element for controlling a flow of the driving current between the driving element and the light emitting element, and a switching circuit for setting a first gate-source voltage of the driving element corresponding to the driving current based on a first data voltage during a first period and setting a second gate-source voltage of the driving element based on a second data voltage different from the first data voltage during a second period following the first period, the second gate-source voltage being different from the first gate-source voltage, and during the second period the emission controlling element is turned off.

The second gate-source voltage is for changing the on-biased state of the driving element to compensate a hysteresis phenomenon of the driving element, and the switching circuit may set the second gate-source voltage a plurality of times based on a plurality of data voltages including the second data voltage during the second period.

The driving element may become a first on-biased state by the first gate-source voltage and become a second on-biased state by the second gate-source voltage, and the first on-biased state and the second on-biased state are different from each other.

The second data voltage may be applied to another pixel during the second period, and a first gate-source voltage of a driving element included in the another pixel may be set according to the second data voltage.

During the emission controlling element is turned on within the first period, the light emitting element may emit light by the driving current applied through the emission controlling element, and the first and second periods are included in one frame.

The electroluminescent display device may further comprise a source driver for generating the first data voltage to supply to a data line connected to the plurality of pixels within the first period, and generating the second data voltage to supply the data line within the second period; and a gate driver for generating a first pulse of a first scan signal synchronized with the first data voltage to supply to a first gate line connected to the plurality of pixels within the first period, generating a second pulse of a first scan signal synchronized with the second data voltage to supply to the first gate line within the second period, and generating a first pulse of a second scan signal synchronized with the second data voltage to supply to a second gate line connected to the plurality of pixels within the second period.

A gate electrode, a first electrode and a second electrode of the driving element may be respectively connected to a second node, a first node and a third node, the emission controlling element may be connected between the third node and a fourth node, the light emitting element may be connected between the fourth node and an input terminal of a low potential power voltage, and the switching circuit may be connected to the data line through which the first and second data voltages are supplied, a first power line through which an initializing voltage is supplied, and a second power line through which a high potential power voltage is supplied.

The switching circuit may comprise a first switching element T1 connected between the first node and the data line, a second switching element T2 connected between the first node and the second power line, a third switching element T3 connected to the second node and the third node, a fourth switching element T4 connected to the second node and the first power line, a fifth switching element T5 connected to the fourth node and the first power line and a storage capacitor connected between the second power line and the second node.

The fourth switching element T4 may be switched according to an (n−1)th scan signal, the first, third and fifth switching elements T1, T3 and T5 may be switched according to an nth scan signal, the nth scan signal being later than the (n−1) the scan signal in their phases of an on period, the emission controlling element and the second switching element T2 may be switched according to an nth emission signal, the (n−1)th scan signal and the nth scan signal may be respectively input as an on level in the first period and the second period sequentially, and the nth emission signal may be input as an off level in the first and second periods and input as the on level in a third period between the first period and the second period.

The method of driving an electroluminescent display device equipped with a plurality of pixels according to another embodiment of the present disclosure, each of the plurality of pixels comprising a driving element for generating a driving current, a light emitting element for emitting light according to the driving current and an emission controlling element for controlling a flow of the driving current between the driving element and the light emitting element, comprises: setting a first gate-source voltage of the driving element corresponding to the driving current based on a first data voltage during a first period; and setting a second gate-source voltage of the driving element based on a second data voltage different from the first data voltage during a second period following the first period, the second gate-source voltage being different from the first gate-source voltage, and during the second period the emission controlling element is turned off.

BRIEF DESCRIPTION OF THE SEVERAL VIEWS OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
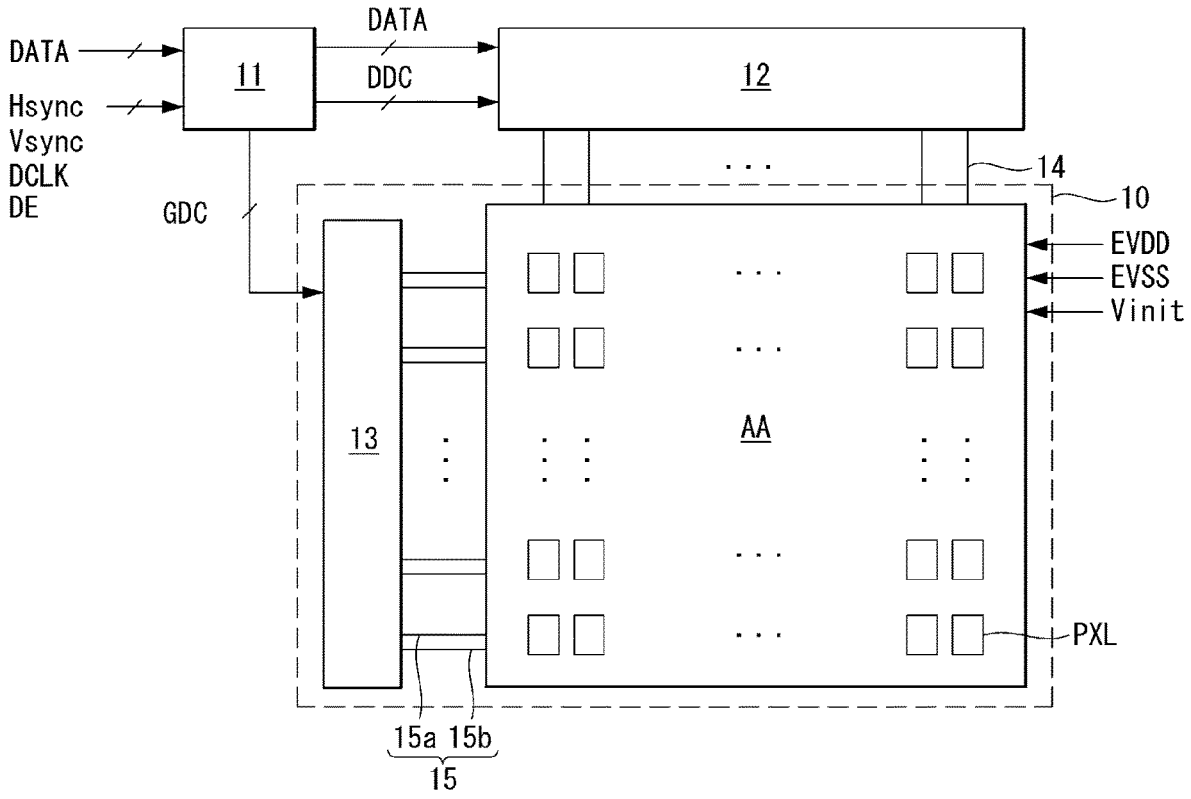
FIG. 1 is a block diagram illustrating an electroluminescent display device according to an embodiment of the present disclosure.

The advantages and features of the present disclosure and methods of accomplishing the same may be understood more readily by reference to the following detailed descriptions of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the present disclosure to those skilled in the art, and the present disclosure is defined by the appended claims.

The shapes, sizes, percentages, angles, numbers, etc. shown in the figures to describe the exemplary embodiments of the present disclosure are merely examples and not limited to those shown in the figures. Like reference numerals denote like elements throughout the specification. In describing the present disclosure, detailed descriptions of related well-known technologies will be omitted to avoid unnecessary obscuring the present disclosure. When the terms 'comprise,' 'have,' 'consist of' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on,' 'over,' 'under,' 'next to' and the like, one or more parts may be positioned between the two parts as long as the term 'immediately' or 'directly' is not used.

It will be understood that, although the terms first, second, etc., may be used to describe various elements, these elements should not be limited by these terms. These terms are only used to distinguish one element from another element.

Thus, a first element referred to below may be a second element within the scope of the present disclosure.

Like reference numerals denote like elements throughout the specification.

The features of various exemplary embodiments of the present disclosure may be combined with one another either partly or wholly, and may technically interact or work together in various ways. The exemplary embodiments may be carried out independently or in combination with one another.

In this specification, the pixel circuit formed on the substrate of a display panel may be implemented by a TFT of a p-type MOSFET structure, but the present disclosure is not limited thereto. The TFT or the transistor is the element of 3 electrodes including a gate, a source and a drain. In one embodiment, a transistor or a TFT may be referred to as an element of the display panel. That is, an element can be in the form of a transistor or a TFT. The source is an electrode for supplying a carrier to the transistor. Within the TFT the carrier begins to flow from the source. The drain is an electrode from which the carrier exits the TFT. That is, the flow of carriers in the MOSFET is from the source to the drain. In the case of a P-type MOSFET (PMOS), since the carrier is the hole, the source voltage has a voltage higher than the drain voltage so that holes can flow from the source to the drain. In the P-type MOSFET, a current direction is from the source to the drain because holes flow from the source to the drain. It should be noted that the source and drain of the MOSFET are not fixed. For example, the source and drain of the MOSFET may vary depending on the applied voltage. Therefore, in the description of the present disclosure, one of the source and the drain is referred to as a first electrode, and the other one of the source and the drain is referred to as a second electrode.

Hereinafter, various embodiments of the present disclosure will be described in detail with reference to the accompanying drawings. The component names used in the following description are selected in consideration of facilitating the specification, and may be different from the parts names of actual products. In the following embodiments, an electroluminescent display device will be described mainly with respect to an organic light emitting display device including organic light emitting material. However, the present disclosure is not limited to the organic light emitting display device, but may be applied to an inorganic light emitting display device including inorganic light emitting material.

Figure 2:
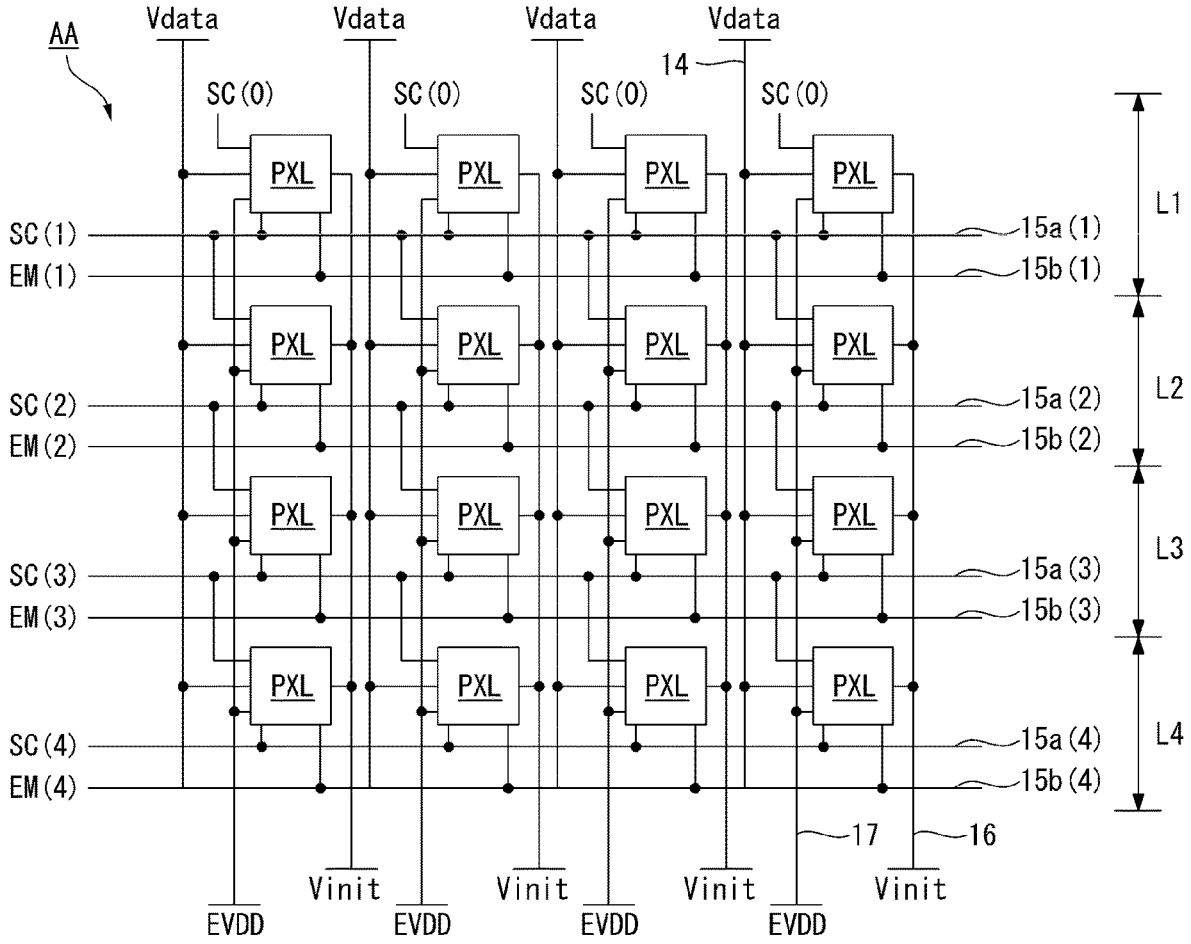
FIG. 2 is a diagram illustrating a pixel array of an electroluminescent display device according to an embodiment of the present disclosure.
Figure 3:
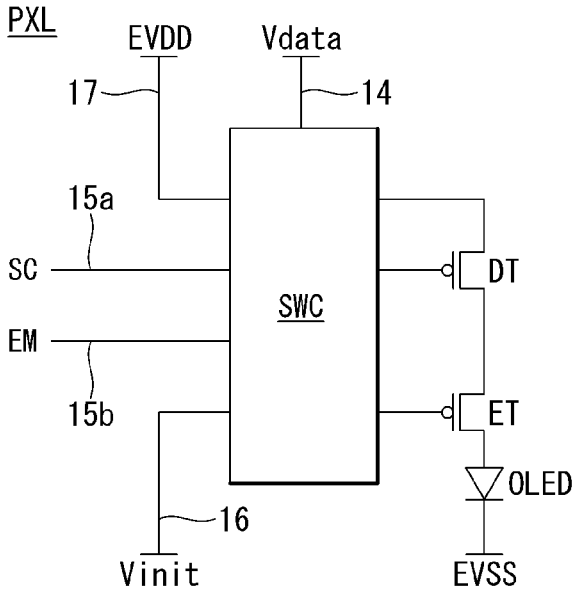
FIG. 3 is a diagram schematically showing an equivalent circuit of the pixel shown in FIG. 2.

FIG. 1 is a block diagram illustrating an electroluminescent display device according to an embodiment of the present disclosure, FIG. 2 is a diagram illustrating a pixel array of an electroluminescent display device according to an embodiment of the present disclosure, and FIG. 3 is a diagram schematically showing an equivalent circuit of the pixel shown in FIG. 2.

Referring to FIGS. 1 to 3, the electroluminescent display device according to the present disclosure comprises a display panel 10 equipped with pixels PXL, driving circuits 12 and 13 for driving the signal lines connected to the pixels PXL, and a timing controller 11 for controlling the driving circuits 12 and 13.

The driving circuits 12 and 13 write input image data DATA to the pixels PXL of the display panel 10. The driving circuits 12 and 13 comprise a source driver 12 for driving the data lines 14 connected to the pixels PXL and a gate driver 13 for driving the gate lines 15 connected to the pixels PXL.

A plurality of data lines 14 and a plurality of gate lines 15 cross each other on the display panel 10, and the pixels PXL are arranged in a matrix form. The pixels PXL may comprise an organic light emitting diode OLED. The OLED that emits light by itself includes an anode electrode, a cathode electrode, and organic compound layers formed therebetween. The organic compound layers include a hole injection layer HIL, a hole transport layer HTL, an emission layer EML, an electron transport layer ETL, and an electron injection layer EIL. When a driving voltage is applied to the anode electrode and the cathode electrode, holes passing through the HTL and electrons passing through the ETL are transferred to the EML to form excitons. As a result, the light emitting layer EML generates visible light.

The display panel 10 may include a display area AA equipped with a pixel array and a non-display area outside of the display area AA. The pixel array is provided with a plurality of horizontal pixel lines L1 to L4 as shown in FIG. 2, and a plurality of pixels PXL adjacent horizontally and connected to the gate lines 15 are disposed on each of the horizontal pixel lines L1 to L4. Here, each of the horizontal pixel lines L1 to L4 is not a physical signal line, but means a pixel group of one line, which is implemented by horizontally neighboring pixels PXL. The pixel array may include an initializing power line 16 for supplying an initializing voltage Vinit to the pixels PXL and a high potential power line 17 for supplying a high potential power voltage EVDD to the pixels PXL. The pixels PXL may be connected to a low potential power voltage EVSS. Each of the gate lines 15 may include a first gate line 15*a* for supplying a scan signal SC and a second gate line 15*b* for supplying an emission signal EM.

Each of the pixels PXL may be one of a red pixel, a green pixel, a blue pixel and a white pixel. The red pixel, the green pixel, the blue pixel, and the white pixel may constitute one unit pixel for color implementation. The color implemented in the unit pixel may be determined according to the emission ratio of the red pixel, the green pixel, the blue pixel, and the white pixel. Each of the pixels PXL may be connected to one data line 14, at least one first gate line 15*a*, one second gate line 15*b*, the initializing power line 16, the high potential power line 17, etc. Each pixel PXL may be further connected to a first gate line 15*a* disposed in a previous horizontal pixel line. Each pixel disposed in a nth horizontal pixel line L(n) is supplied with a nth scan signal SC(n) and a nth emission line EM(n) assigned to the nth horizontal pixel line L(n) and a (n−1)th scan signal SC(n−1) assigned to a (n−1)th horizontal pixel line L(n−1). However, gate lines connected to each pixel PXL and gate signals may vary depending on the circuit configuration of the pixel PXL.

Each pixel PXL may comprise a driving TFT DT for generating a driving current, an OLED for emitting light according to the driving current and a switching circuit SWC for programing a voltage between a gate and a source of the driving TFT DT, as shown in FIG. 3. Each pixel PXL may further comprise an emission controlling TFT ET for turning on/off a current flow between the driving TFT DT and the OLED for PWM (Pulse Width Modulation) driving. The PWM driving is to control the emission duty of the OLED in one frame to remove flicker and afterimage in a low gradation representation. An off period of the emission controlling TFT ET for PWM driving may be determined according to a predetermined PWM duty ratio.

Each of the pixels PXL may change the on-biased state of the driving TFT DT at least once within the off period of the emission controlling TFT ET so that the level of the hysteresis phenomenon can be reduced. For this purpose, each of the pixels PXL may change the gate-source voltage of the driving TFT DT equal to or more than twice in one frame based on a multi-scan driving method.

The source driver 12 converts input image data DATA received from the timing controller 11 every frame into data voltages Vdata, and then supplies the data voltages to the data lines 14. The source driver 12 uses a digital-to-analog converter DAC converting the input image data DATA into gamma compensation voltages to output the data voltages Vdata.

A multiplexer may be disposed between the source driver 12 and the data lines 14 of the display panel 10. The multiplexer distributes the data voltages output through one output channel to the plurality of the data lines, thereby reducing the number of the output channels of the source driver 12 to the number of the data lines. The multiplexer may be omitted depending on the resolution or purpose of display devices.

The source driver 12 may further comprise a power generating unit. The power generating unit may generate an initializing voltage Vinit to supply to the initializing power line 16 and generate a high potential power voltage EVDD to supply to the high potential power line 17. The power generating unit may further generate a low potential power voltage EVSS. The power generating unit may be mounted outside the source driver 12 and then be connected to the source driver 12 via a conductive film, etc. The initializing voltage Vinit may be designed to be within considerably lower voltage ranges than the operation voltage of the OLED, in order to prevent the OLED from unnecessarily emitting light during an initializing period and a sampling period.

The gate driver 13 may comprise a first gate driver for generating the scan signals SC(1)~SC(4) of FIG. 2 and a second gate driver for generating the emission signals EM(1)~EM(4).

The first gate driver includes stages as many as the horizontal pixel lines L1~L4 and outputs the scan signals SC(1)~SC(4) under the control of the timing controller 11. The first gate driver may be implemented by a shift register and sequentially supply the scan signals SC(1)~SC(4) to first gate lines 15*a*(1)~15*a*(4) through a plurality of first output nodes. The first gate driver may sequentially supply the scan signals SC(1)~SC(4) to the first gate lines 15*a*(1)~15*a*(4) a plurality of times in one frame the according to a multi-scan driving method.

The second gate driver includes stages as many as the horizontal pixel lines L1~L4 and outputs the emission signals EM(1)~EM(4) under the control of the timing controller 11. The second gate driver may be implemented by a shift register and sequentially supply the emission signals EM(1)~EM(4) to second gate lines 15*b*(1)~15*b*(4) through a plurality of second output nodes.

To simplify the configuration of the gate driver 13, each of the first output nodes may be commonly connected to two adjacent horizontal pixel lines. In order to drive the pixels PXL in FIG. 7, two scan signals having different on-timings are necessary. For example, if an (n−1)th scan signal SC(n−1) and a nth scan signal SC(n) are used as two scan signals applied to the pixels of a nth horizontal pixel line Ln, one gate driver may be omitted so an advantage occurs of simplifying the configuration of the gate driver 13. In this case, since the (n−1)th scan signal SC(n−1) and the nth scan signal SC(n) are sequentially output from one gate driver, the pulse widths of the two scan signals are same but the phases are different from each other The gate drive 13 may be directly formed on a non-display area of the display panel 10 with the pixel array through the process of a gate-driver in panel GIP, but is not limited thereto. The gate driver 13 may be manufactured in an IC type and then bonded to the display panel 10 through a conductive film.

The timing controller 11 receives digital data DATA of input image and timing signals synchronized with the digital data from a host system. The timing signals includes a vertical synchronization signal Vsync, a horizontal synchronization signal Hsync, a dot clock signal DCLK, and a data enable signal DE. The host system may be one of a television system, a set-top box, a navigation system, a DVD player, a Blu-ray player, a personal computer, a home theater system and a phone system or the like.

The timing controller 11 may multiply an input frame frequency by i (i is a positive integer larger than 0) times and control the operation timings of the driving circuits 12 and 13 at a frame frequency of the input frame frequency x i Hz. The input frame frequency is 60 Hz in the NTSC (National Television Standards Committee) scheme and 50 Hz in PAL (Phase-Alternating Line) scheme.

The timing controller 11 generates the data control signal DDC for controlling the operation timings of the source driver 12 and the gate control signal GDC for controlling the operation timings of the gate driver 13, based on the timing signals received from the host system.

The data control signal DDC includes a source start pulse, a source sampling clock, a source output enable signal, and the like. The source start pulse controls the sampling start timing of the source driver 12. The source sampling clock is a clock signal that shifts data sampling timings. If the signal transmitting interface between the timing controller 11 and the source driver 12 is a mini-LVDS (Low Voltage Differential Signaling) interface, the source start pulse and the source sampling clock may be omitted.

The gate control signal GDC includes a gate start pulse, a gate shift clock, a gate output enable signal, and the like. In case of the GIP circuit, the gate output enable signal may be omitted. The gate start pulse is generated at the beginning of a frame period every frame period, and input to a shift register of each gate driver 13. The gate start pulse controls the start timing, at which the scan signals and the emission signals are output, every frame period. The gate shift clock is input to a shift register of the gate driver 13 to control the shift timings of the gate signals.

Figure 4:
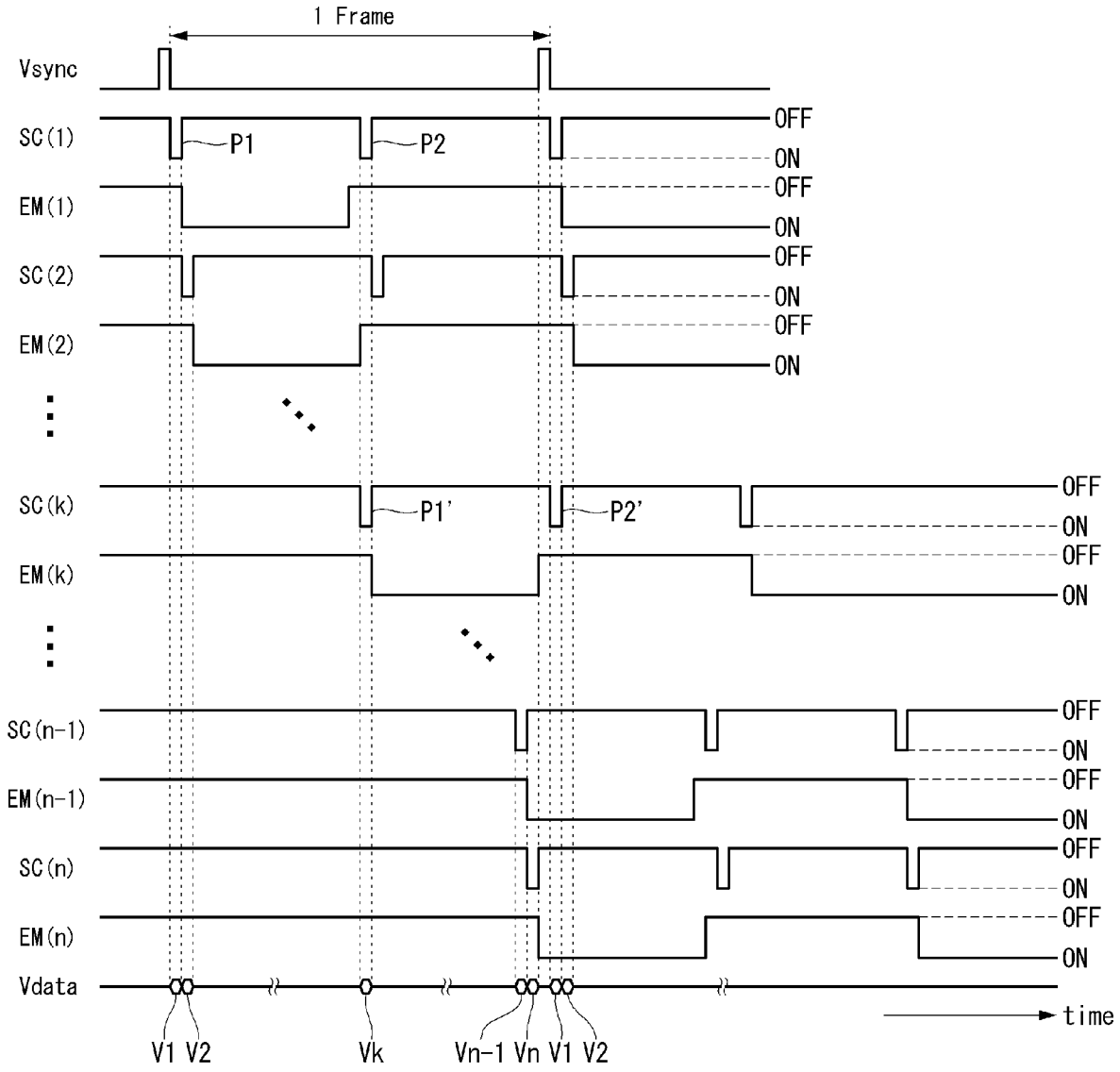
FIG. 4 is a waveform diagram showing an example of the multi-scan driving method for improving hysteresis phenomenon.
Figure 5:
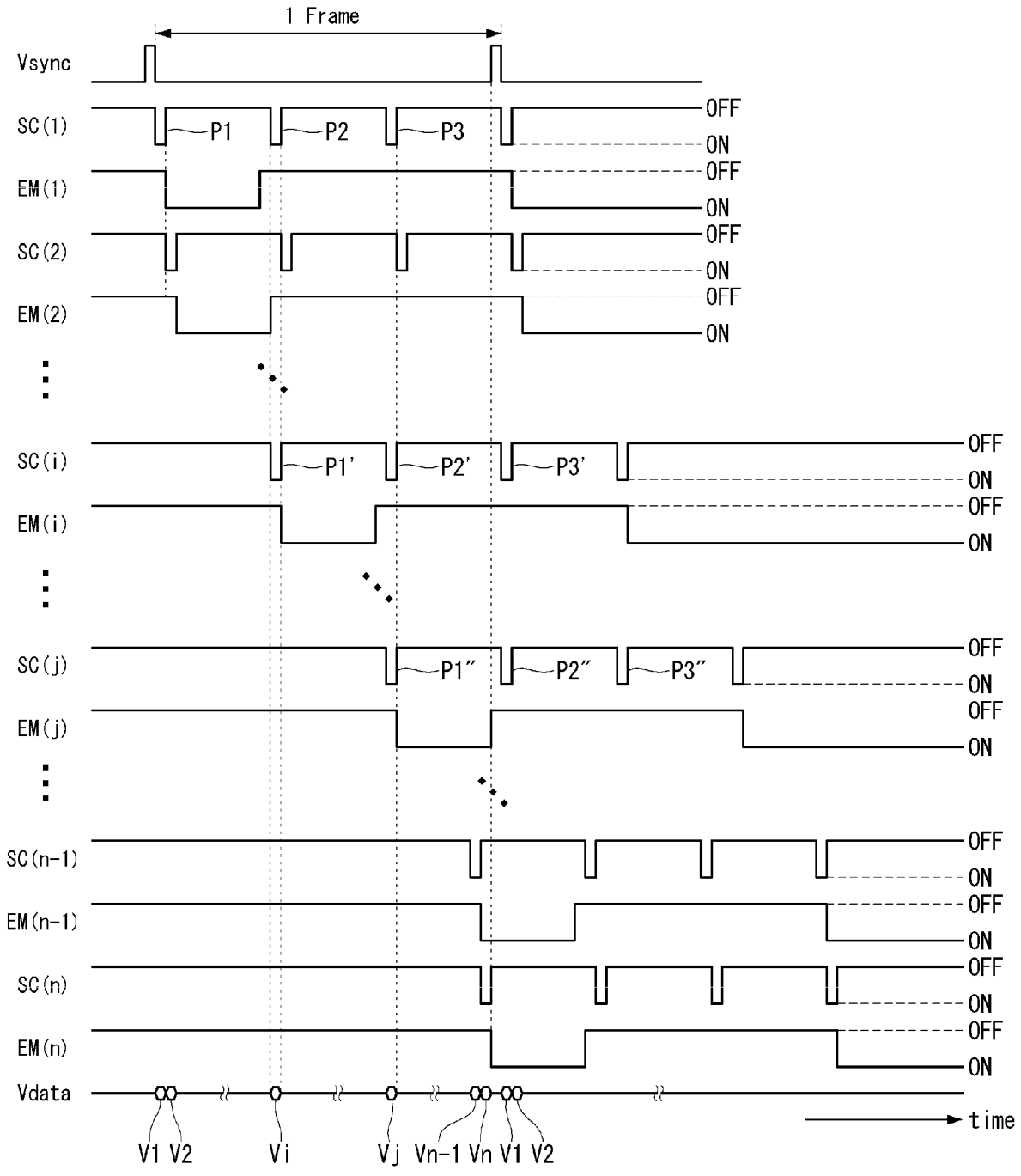
FIG. 5 is a waveform diagram showing another example of the multi-scan driving method for improving hysteresis phenomenon.

FIG. 4 is a waveform diagram showing an example of the multi-scan driving method for improving hysteresis phenomenon and FIG. 5 is a waveform diagram showing another example of the multi-scan driving method for improving hysteresis phenomenon.

The on-biased state of the driving TFT DT may be implemented by the gate-source voltage of the driving TFT DT satisfying a conducting condition. Each pixel PXL may be further supplied with the data voltage assigned to another pixel within an off-state duration of the emission controlling TFT ET, in order for the on-biased state to be changed at least one time in one frame. For this, each pixel PXL may be applied with two or more data voltages in the multi-scan method such as FIGS. 4 and 5.

Referring to FIG. 4, for the multi-scan driving, each of the scan signals SC(1)~SC(n) may be input as an on level ON twice within one frame. In this case, each of the scan signals SC(1)~SC(n) includes a first pulse of a scan signal corresponding to a first on level ON and a second pulse of the scan signal corresponding to a second on level ON. At this time, each of the emission signals is input as an on level ON between the first pulse of the scan signal and the second pulse of the scan signal, and input as an off level OFF while overlapping the first pulse of the scan signal and the second pulse of the scan signal. The off level periods OFF of the emission signals EM(1)~EM(n) correspond to the off period of the emission controlling TFT ET.

Referring to FIG. 4, the example, in which a pixel A is driven according to a first scan signal SC(1) and a first emission signal EM(1) and a pixel B is driven according to a second scan signal SC(2) and a second emission signal EM(2), is described as follows. The pixel A and the pixel B are connected to a same data line 14.

Referring to FIG. 4, in the pixel A, a first gate-source voltage of the driving TFT DT is set based on a first data voltage V1 in a first period and a second gate-source voltage of the driving TFT DT may be set based on a second data voltage Vk different from the first data voltage V1 in a second period, following the first period, during which the emission controlling TFT ET is turned off. Here, the first gate-source voltage is for generating a driving current emitting the OLED in the pixel A, and the second gate-source voltage is for changing the on-biased state of the driving TFT DT in the pixel A to lower the hysteresis phenomenon. The emission controlling TFT ET is turned on in the first period, and the OLED emits light by the driving current during the emission controlling TFT ET is turned on. The first and second periods are included in one frame period.

Referring to FIG. 4, the source driver 12 generates the first data voltage V1 to supply to the data lines 14 connected to the pixels A and B in the first period, and generates the second data voltage Vk to supply to the data lines 14 connected to the pixels A and B in the second period. And, the gate driver 13 generates a first pulse of a first scan signal (P1 of SC(1)) synchronized with the first data voltage V1 to supply to the first gate line connected to the pixel A in the first period, and generates a second pulse of the first scan signal (P2 of SC(1)) synchronized with the second data voltage Vk to supply to the first gate line in the second period. Also, the gate driver 13 generates a first pulse of a second scan signal (P1' of SC(k)) synchronized with the second data voltage Vk to supply to a second gate line connected to the pixel B in the second period.

So, the second data voltage Vk is input to the pixel A and the pixel B simultaneously in the second period. In the case of the pixel A, the second gate-source voltage of the driving TFT DT is set according to the second data voltage Vk. On the other hand, in the case of the pixel B, the first gate-source voltage of the driving TFT DT is set according to the second data voltage Vk.

With respect to all pixels, the period becomes short during which a first on-biased state in accordance with the first gate-source voltage is changed into a second on-biased state in accordance with the second gate-source voltage within one frame. Accordingly, since the time that the gate-source voltage of the driving TFT DT remains the same becomes short, the hysteresis phenomenon can be alleviated.

Meanwhile, referring to FIG. 5, each of the scan signals SC(1)~SC(n) may be input while having the on level ON three times within one frame, for the multi-scan driving. In this case, each of the scan signals SC(1)~SC(n) includes a first pulse of a scan signal corresponding to a first on level ON, a second pulse of the scan signal corresponding to a second on level ON and a third pulse of the scan signal corresponding to a third on level ON. At this time, each of the emission signals EM(1)~EM(n) is input as an on level ON between the first pulse of the scan signal and the second pulse of the scan signal, and input as an off level OFF while overlapping the first pulse of the scan signal, the second pulse of the scan signal and the third pulse of the scan signal. The off period of the emission controlling TFT ET becomes the off level OFF period of the emission signals EM(1)~EM(n).

Referring to FIG. 5, the example, in which a pixel A is driven according to a first scan signal SC(1) and a first emission signal EM(1), a pixel B is driven according to a second scan signal SC(i) and a second emission signal EM(i) and a pixel C is driven according to a third scan signal SC(j) and a third emission signal EM(j), is described as follows. The pixels A, B and C are connected to a same data line 14.

Referring to FIG. 5, in the pixel A, a first gate-source voltage of the driving TFT DT is set based on a first data voltage V1 in a first period, a second gate-source voltage of the driving TFT DT may be set two times based on second data voltages Vi and Vj different from the first data voltage V1 in a second period during which the emission controlling TFT ET is turned off. Here, the first gate-source voltage is for generating a driving current emitting the OLED in the pixel A, and the second gate-source voltage is for changing the on-biased state of the driving TFT DT in the pixel A to lower the hysteresis phenomenon. And, the second gate-source voltage is different from the first gate-source voltage. Setting the second gate-source voltage multiple times also has the advantage that the response speed is improved. Since the emission controlling TFT ET is turned on in the first period, the OLED emits light by the driving current during the emission controlling TFT ET is turned on. The first and second periods are included in one frame period.

Referring to FIG. 5, the source driver 12 generates the first data voltage V1 to supply to the data lines 14 connected to the pixels A, B and C in the first period, and generates the second data voltages Vi and Vj to supply to the data lines 14 connected to the pixels A, B and C in the second period. And, in the first period, the gate driver 13 generates a first pulse of a first scan signal (P1 of SC(1)) synchronized with the first data voltage V1 to supply to the first gate line connected to the pixel A. In the second period, the gate driver 13 also generates a second pulse of the first scan signal (P2 of SC(1)) synchronized with the second data voltage Vi to supply to the first gate line and then generates a third pulse of the first scan signal (P3 of SC(1)) synchronized with the second data voltage Vj to supply to the first gate line in the second period. Also, in the second period, the gate driver 13 generates a first pulse of a second scan signal (P1' of SC(i)) synchronized with the second data voltage Vi to supply to a second gate line connected to the pixel B and then generates a first pulse of a third scan signal (P1" of SC(j)) synchronized with the second data voltage Vj to supply to a third gate line connected to the pixel C.

So, the second data voltage Vi is input to the pixel A and the pixel B simultaneously in the second period. In the case of the pixel A, the second gate-source voltage of the driving TFT DT is set according to the second data voltage Vi. On the other hand, in the case of the pixel B, the first gate-source voltage of the driving TFT DT is set according to the second data voltage Vi.

Also, the second data voltage Vj is input to the pixels A, B and C simultaneously in the second period. In the case of the pixels A and B, the second gate-source voltage of the driving TFT DT is set according to the second data voltage Vj. On the other hand, in the case of the pixel C, the first gate-source voltage of the driving TFT DT is set according to the second data voltage Vj.

With respect to all pixels, the period, during which a first on-biased state in accordance with the first gate-source voltage is changed into a second on-biased state in accordance with the second gate-source voltage within one frame, becomes shorter than FIG. 4. Accordingly, since the time that the gate-source voltage of the driving TFT DT remains the same becomes short, the hysteresis phenomenon can be alleviated.

Figure 6A:
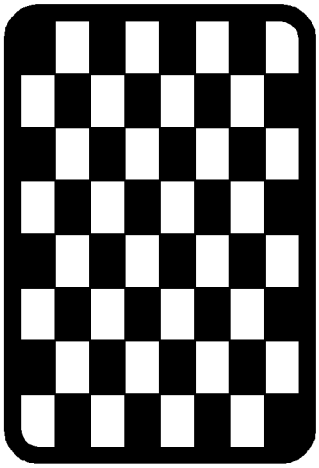
FIGS. 6A to 6C shows that an afterimage is improved according to the multi-scan driving method.
Figure 6B:
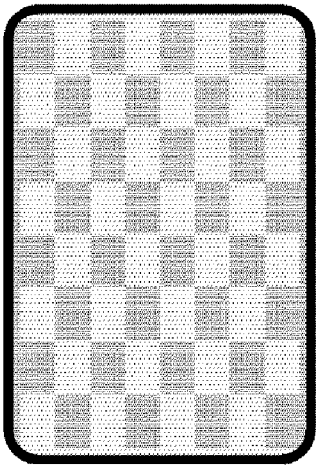
Figure 6C:
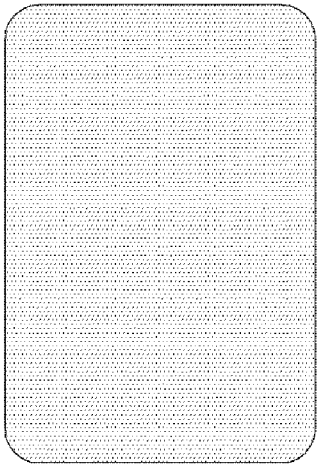

FIGS. 6A-6C shows that an afterimage is improved according to the multi-scan driving method.

The degree of the hysteresis phenomenon is proportional to the time during which the gate-source voltage of the driving TFT is maintained. If the image such as FIG. 6A is displayed for a long time, the afterimage such as FIG. 6B appears. When the threshold voltage of the driving TFT is compensated in each pixel, the hysteresis phenomenon causes a mis-compensation and induces a DC afterimage to reduce display quality. If the time that the gate-source voltage of the driving TFT is maintained is reduced within one frame through the multi-scan driving such as FIGS. 4 and 5 of the present disclosure, the DC afterimage can be remarkably reduced and the display quality can be improved as shown in FIG. 6C. According to the present description, by also applying the data voltage applied to a second pixel to the driving TFT of a first pixel during the emission controlling TFT is turned off within one frame, the hysteresis phenomenon of the driving TFT of the first pixel can be effectively improved without an additional increase in driving time.

Figure 7:
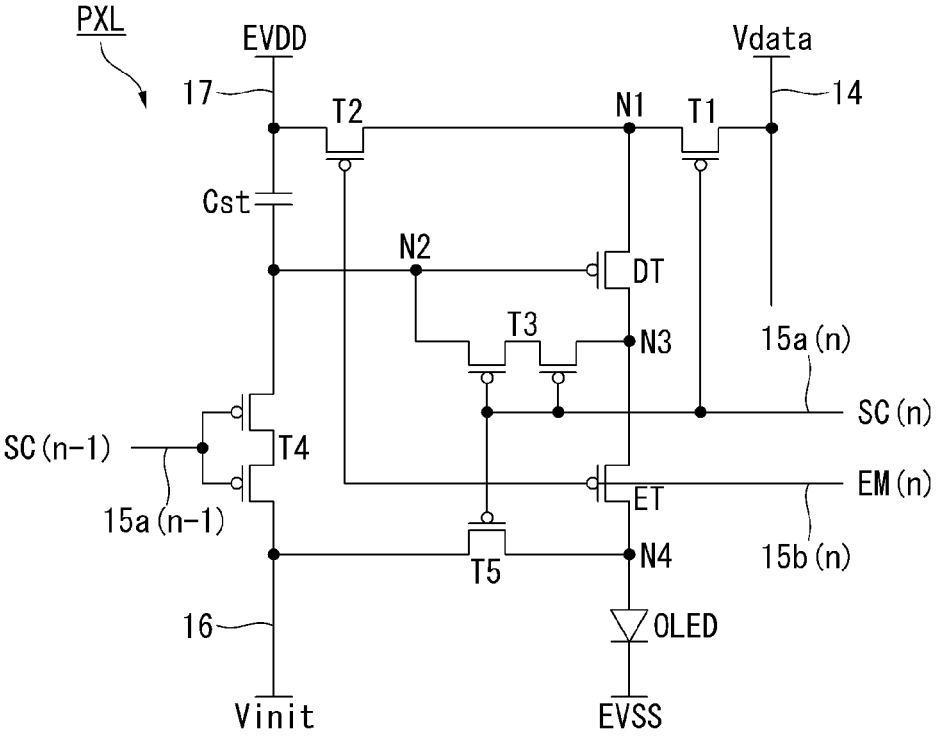
FIG. 7 specifically shows the equivalent circuit of the pixel shown in FIG. 2.

FIG. 7 specifically shows the equivalent circuit of the pixel shown in FIG. 2.

Referring to FIG. 7, the pixel PXL according to one embodiment of the present disclosure comprises an OLED, a plurality of TFTs (T1~T5, ET, DT) and a storage capacitor Cst. The TFTs (T1~T5, ET, DT) may be implemented by low-temperature polycrystalline silicon (LTPS) TFTs of a PMOS type having good response characteristics. But, the technical idea of the present description is not limited thereto. For example, some TFTs connected to the gate electrode of the driving TFT DT among switching TFTs (T1~T5) may be implemented by oxide TFTs of a NMOS type having good off-current characteristics, and the remaining TFTs may be implemented as LTPS TFTs of a PMOS type having good response characteristics.

Hereinafter, the connection structure of one pixel PXL arranged on an nth horizontal pixel line will be described in detail.

The OLED is a device which emits light according to the driving current input from the driving TFT DT. The anode electrode of the OLED is connected to fourth node N4, and the cathode electrode of the OLED is connected to the input terminal of the low potential voltage EVSS. An organic compound layer is provided between the anode electrode and the cathode electrodes.

The driving TFT DT is a device which generates the driving current flowing through the OLED according to a first gate-source voltage within a first period. During a second period during which the emission controlling TFT ET is turned off, the driving TFT DT compensates for the hysteresis phenomenon according to a second gate-source voltage different from the first gate-source voltage. The driving TFT DT includes a gate electrode connected to a second node N2, a first electrode connected to a first node N1, and a second electrode connected to a third node N3.

The emission controlling TFT ET is a device which is connected between the third node N3 and a fourth node N4 and switched according to an nth emission signal EM(n). The emission controlling TFT ET controls the driving current so that the OLED can be repeatedly turned on and off with a constant emission duty ratio. The gate electrode of the emission controlling TFT ET is connected to an nth second gate line 15*b*(*n*) to which an nth emission signal EM(n) is applied, a first electrode of the emission controlling TFT ET is connected to the third node N3 and a second electrode of the emission controlling TFT ET is connected to the fourth node N4.

The first switching TFT T1 is connected between the data line 14 and the first node N1 and switched according to an nth scan signal SC(n). The gate electrode of the first switch T1 is connected to the nth first gate line 15*a*(*n*) to which the nth scan signal SC(n) is applied, a first electrode of the first switch T1 is connected to the data line 14 and a second electrode of the first switch T1 is connected to the first node N1.

The second switching TFT T2 is connected between the high potential power line 17 and the first node N1 and switched according to the nth emission signal EM(n). The gate electrode of the second switching TFT T2 is connected to the nth second gate line 15*b*(*n*) to which the nth emission signal EM(n) is applied, a first electrode of the second switching TFT T2 is connected to the high potential power line 17, and a second electrode of the second switching TFT T2 is connected to the first node N1.

The third switching TFT T3 is connected between the second node N2 and the third node N3 and switched according to the nth scan signal SC(n). The gate electrode of the third switching TFT T3 is connected to the nth first gate line 15*a*(*n*) to which the nth scan signal SC(n) is applied, a first electrode of the third switching TFT T3 is connected to the third node N3, and a second electrode of the third switching TFT T3 is connected to the second node N2.

The fourth switching TFT T4 is connected between the second node N2 and the initializing power line 16, and switched according to an (n−1)th scan signal SC(n−1). The gate electrode of the fourth switching TFT T4 is connected to an (n−1)th first gate line 15*a*(n−1) to which the (n−1)th scan signal SC(n−1) is applied, a first electrode of the fourth switching TFT T4 is connected to the second node N2, and a second electrode of the fourth switching TFT T4 is connected to the initializing power line 16.

The fifth switching TFT T5 is connected between the fourth node N4 and the initializing power line 16, and switched according to the nth scan signal SC(n). The gate electrode of the fifth switching TFT T5 is connected to the nth first gate line 15*a*(*n*) to which the nth scan signal SC(n) is applied, a first electrode of the fifth switching TFT T5 is connected to the fourth node N4, and a second electrode of the fifth switching TFT T5 is connected to the initializing power line 16.

The storage capacitor Cst is connected between the high potential power line 17 and the second node N2.

Meanwhile, the third and fourth switching TFTs T3 and T4 may be designed as a dual gate configuration in order to suppress a leakage current occurring when turned off. In the dual gate configuration, two gate electrodes are connected to each other in order to have a same potential. Because the channel length of the dual gate configuration becomes longer than that of a single gate configuration, an off resistance is increased and an off current is reduced, which ensure the stability of operation.

Figure 8:
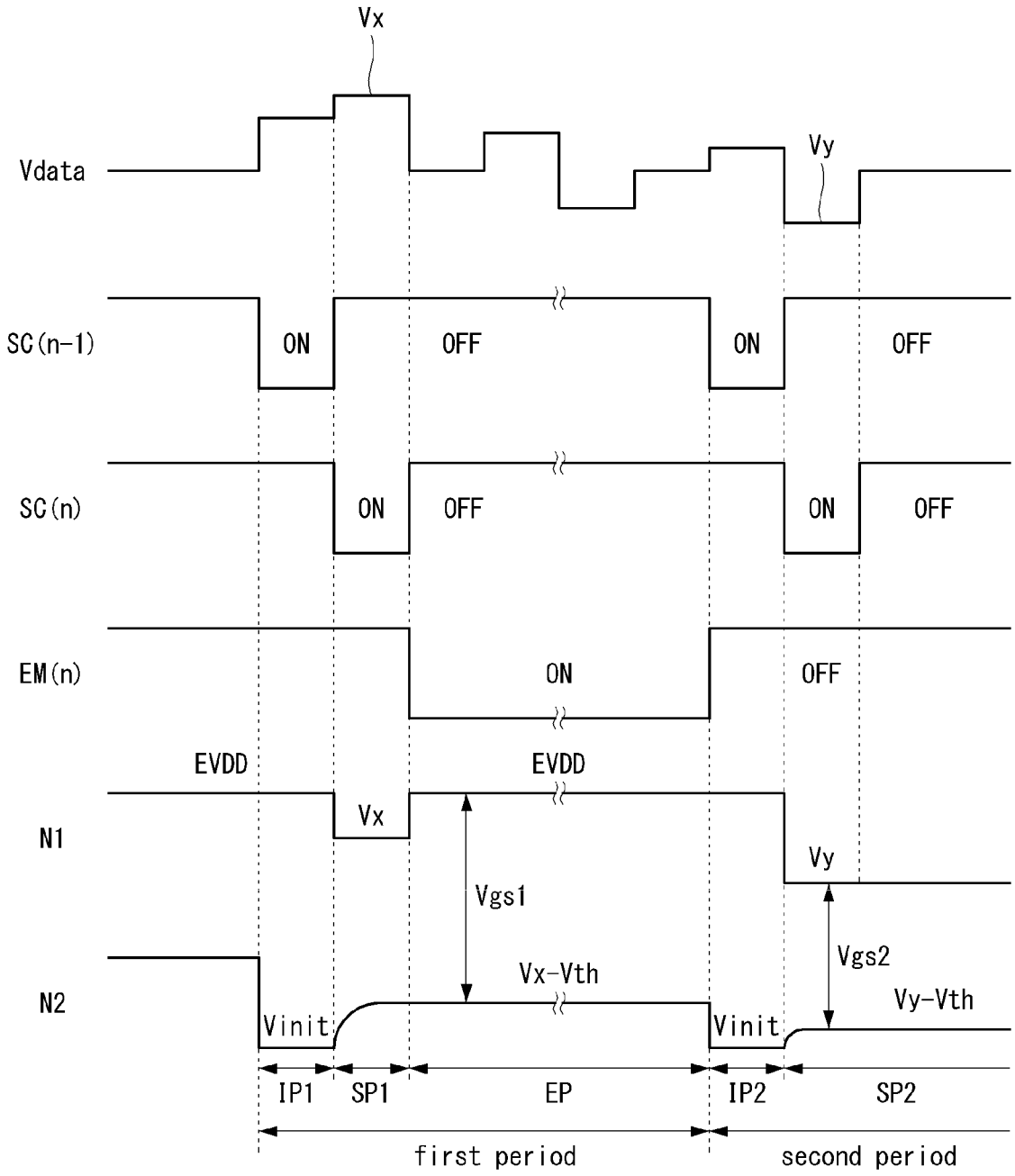
FIG. 8 is a waveform diagram showing driving signals input to the pixel of FIG. 7 and potential changes of specific pixel nodes according to the driving signals.

FIG. 8 is a waveform diagram showing driving signals input to the pixel of FIG. 7 and potential changes of specific pixel nodes according to the driving signals. And, FIGS. 9A to 9E show the operation states of the pixel during the first initializing period, a first sampling period, an emission period, a second initializing period and a second sampling period of FIG. 8.

Referring to FIG. 8, a first frame period for driving each pixel PXL disposed on an nth horizontal pixel line Ln may comprise a first initializing period IP1, a first sampling period SP1 following the first initializing period, an emission period EP following the first sampling period, a second initializing period IP2 following the emission period, and a second sampling period SP2 following the second initializing period. Here, the first initializing period IP1, the first sampling period SP1 and the emission period EP may be included in the first period described in the embodiments of FIGS. 4 and 5 and claims, and the second initializing period IP2 and the second sampling period SP2 may be included in the second period described in the embodiments of FIGS. 4 and 5 and claims.

Referring to FIG. 8, in the first initializing period IP1, the (n−1)th scan signal SC(n−1) is input as an on level ON, and the nth scan signal SC(n) and the nth emission signal EM(n) are input as an off level OFF. The first initializing period IP1 is for resetting the second node N2 by the initializing voltage Vinit before the first sampling period SP1.

Figure 9A:
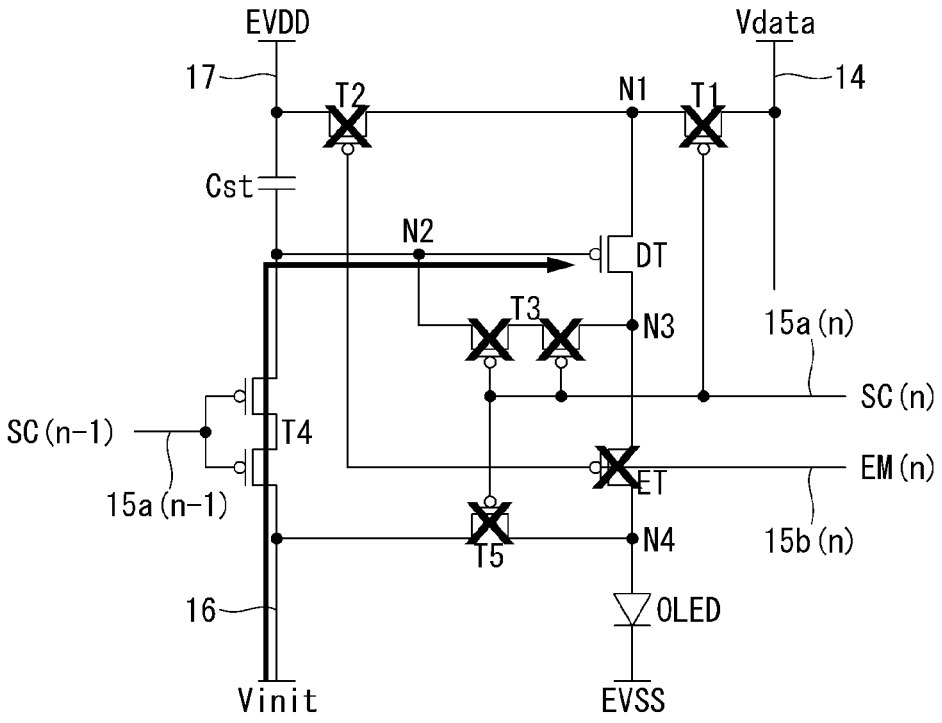
FIG. 9A is an equivalent circuit diagram showing the operation of the pixel during a first initializing period of FIG. 8.

Referring to FIG. 9A, during the first initializing period IP1, the fourth switching TFT T4 is turned on responding to the (n−1)th scan signal SC(n−1) of an on level ON. The initializing voltage Vinit is applied to the node N2 by the turn-on operation of the fourth switching TFT T4, so that the gate potential of the drive TFT DT is reset to the initializing voltage Vinit.

Referring to FIG. 9A, during the first initializing period IP1, the first, third and fifth switching TFTs T1, T3 and T3 are turned off responding to the nth scan signal SC(n) of an off level OFF, and the second switching TFT T2 and the emission controlling TFT ET are turned off responding to the nth emission signal EM(n) of an off level OFF.

Referring to FIG. 8, during the first sampling period SP1, the nth scan signal SC(n) is input as the on level ON and the (n−1)th scan signal SC(n−1) and the nth emission signal EM(n) are input as the off level OFF. The first sampling period SP1 is for sampling the threshold voltage of the driving TFT DT.

Figure 9B:
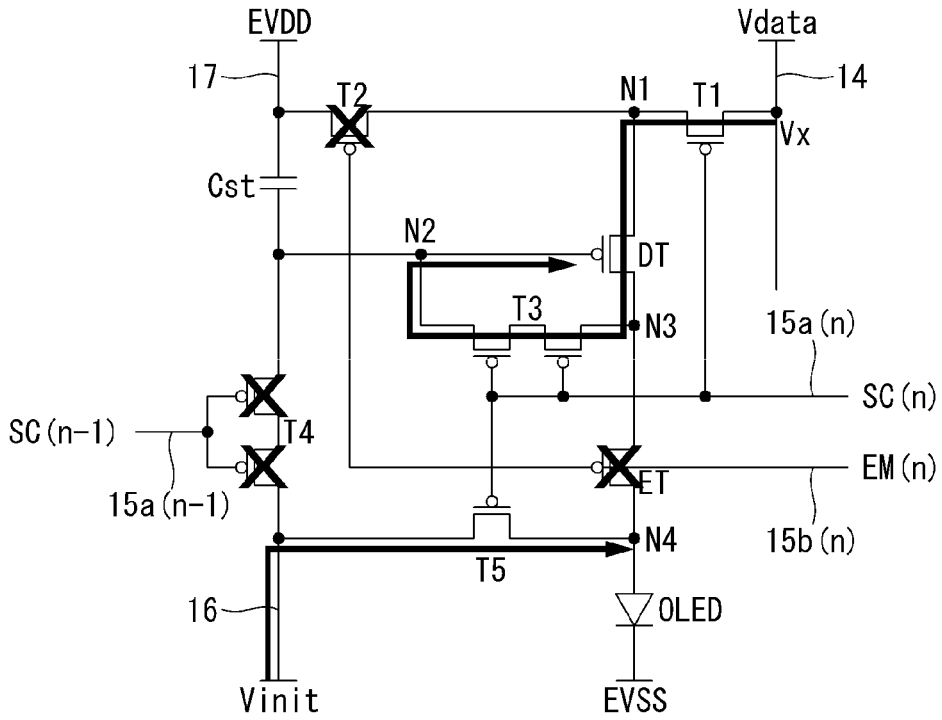
FIG. 9B is an equivalent circuit diagram showing the operation of the pixel during a first sampling period of FIG. 8.

Referring to FIG. 9B, during the first sampling period SP1, the first, third and fifth switching TFTs T1, T3 and T5 are turned on responding to the nth scan signal SC(n). The potential of the first node N1 is changed into a data voltage Vx due to the turning on of the first switching TFT T1. The gate electrode and the second electrode of the driving TFT DT are short-circuited by the turning on of the third switching TFT T3, so the driving TFT DT is diode-connected. If a current flows through the driving TFT DT with being diode-connected, the threshold voltage of the driving TFT DT is sampled and stored at the second node N2 and the third node N3. That is, the potential of the second node N2 and the third node N3 becomes (Vx−Vth). The gate-source voltage Vgs of the driving TFT DT is the voltage between the first node N1 and the second node N2. So, during the first sampling period SP1, the first gate-source voltage of the driving TFT DT becomes the threshold voltage of the driving TFT DT.

Referring to FIG. 9B, during the first sampling period SP1, the potential of the fourth node N4 is reset to the initializing voltage Vinit by the turning on of the fifth switching TFT T5 so unnecessary emission of the OLED can be prevented.

Referring to FIG. 9B, during the first sampling period SP1, the fourth switching TFT T4 is turned off responding to the (n−1)th scan signal SC(n−1) of the off level OFF, and the second switching TFT T2 and the emission controlling TFT ET maintain their turn-off states responding to the nth emission signal EM(n) of the off level OFF.

Referring to FIG. 8, during the emission period EP, the (n−1)th scan signal SC(n−1) and the nth scan signal SC(n) are input as the off level OFF, and the nth emission signal EM(n) is input as the on level ON. The emission period EP is for setting the first gate-source voltage of the driving TFT DT corresponding to a driving current based on a data voltage Vx. And the emission period EP is for emitting the OLED according to the driving current flowing through the driving TFT DT.

Figure 9C:
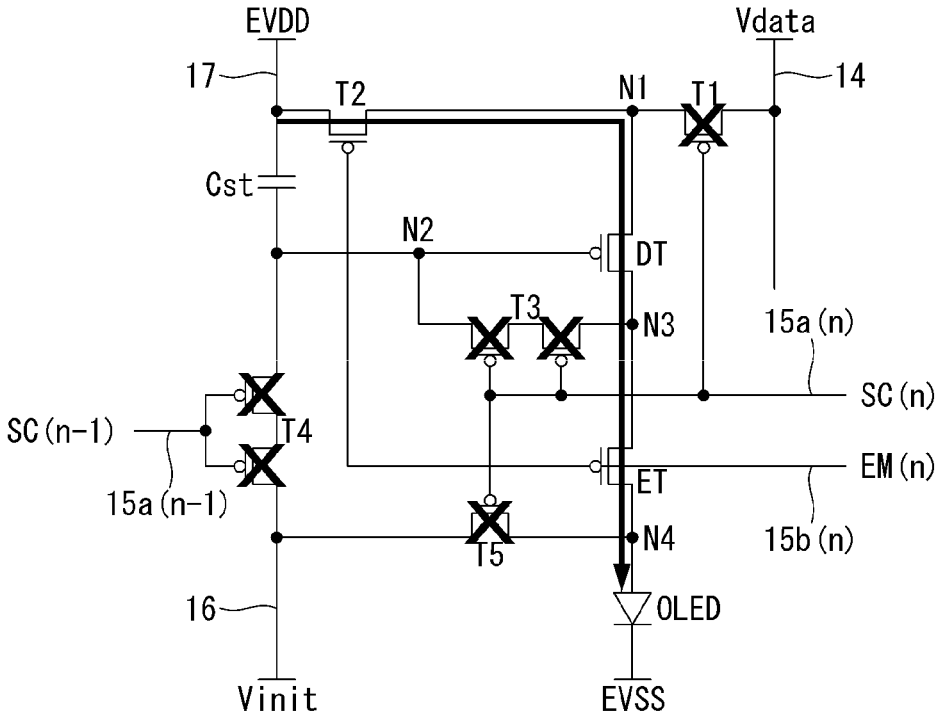
FIG. 9C is an equivalent circuit diagram showing the operation of the pixel during an emission period of FIG. 8.

Referring to FIG. 9C, during the emission period EP, the second switching TFT T2 and the emission controlling TFT ET are turned on responding to the nth emission signal EM(n) of the on level ON. During the emission period EP, the potential of the first node N1 is changed from the data voltage Vx to the high potential power voltage EVDD by the turning on of the second switching TFT T2. During the emission period EP, the potential of the second node N2 maintains (Vx−Vth) which is stored in the first sampling period SP1 by the storage capacitor Cst. So, during emission period EP, the first gate-source voltage Vgs1 of the driving TFT DT becomes (EVDD−Vx+Vth), and a driving current corresponding thereto flows the driving TFT DT. This driving current is applied to the OLED via the emission controlling TFT ET.

The driving current Ioled flowing to the OLED during the emission period EP is expressed as a function independent of the threshold voltage of the driving TFT DT as shown in the following Equation 1.

$$\begin{aligned} Ioled &= K(Vgs - |Vth|)^2 \\ &= K(EVDD - \{Vx - |Vth|\} - |Vth|)^2 \\ &= K(EVDD - Vx)^2 \end{aligned} \quad \text{[Equation 1]}$$

Here, K is a constant value determined by the mobility, the channel ratio, parasitic capacity, etc. of the driving TFT DT.

Referring to FIG. 9C, during the emission period EP, the fourth switching TFT T4 maintains its turn-off state in response to the (n−1)th scan signal SC(n−1) of the off level OFF. And, during the emission period EP, the first, third and fifth switching TFTs T1, T3 and T5 are turned off in response to the nth scan signal SC(n) of the off level OFF.

Referring to FIG. 8, in the second initializing period IP2, the (n−1)th scan signal SC(n−1) is input as the on level ON, and the nth scan signal SC(n) and the nth emission signal EM(n) are input as the off level OFF. The second initializing period IP2 is for resetting the second node N2 to the initializing voltage Vinit prior to the second sampling period SP2.

Figure 9D:
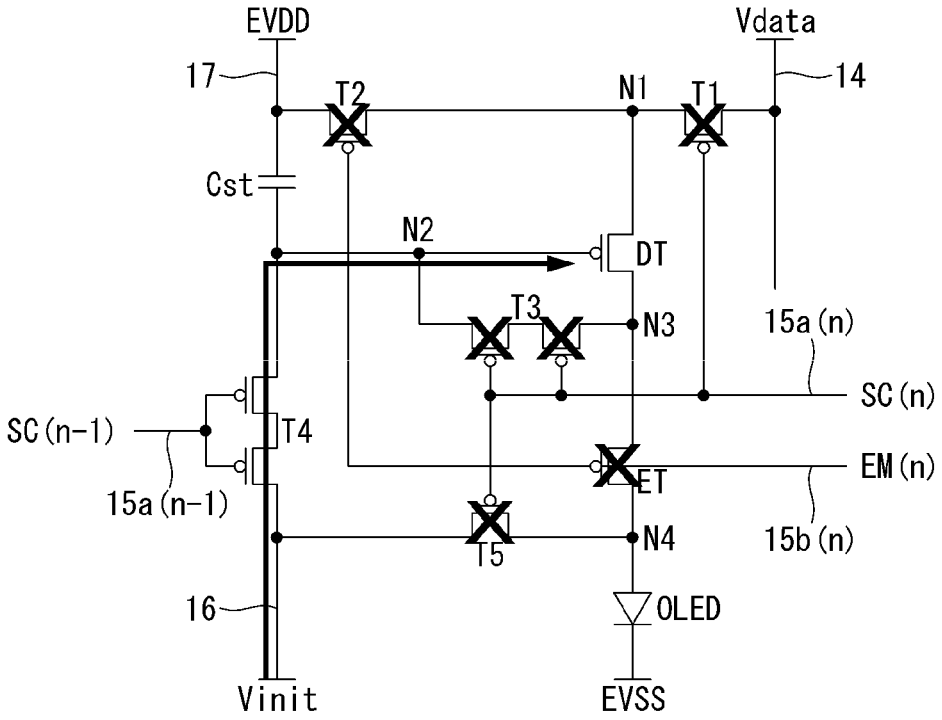
FIG. 9D is an equivalent circuit diagram showing the operation of the pixel during a second initializing period of FIG. 8.

Referring to FIG. 9D, during the second initializing period IP2, the fourth switching TFT T4 is turned on in response to the (n−1)th scan signal SC(n−1) of the on level ON. The initializing voltage Vinit is applied to the second node N2 by turning on the fourth switching TFT T4 and the gate potential of the driving TFT DT is reset again to the initializing voltage Vinit.

Referring to FIG. 9D, during the second initializing period IP2, the first, third and fifth switching TFTs T1, T3 and T5 are turned off in response to the nth scan signal SC(n) of the off level OFF, and the second switching TFT T2 and the emission controlling TFT ET are turned off in response to the nth emission signal EM(n) of the off level OFF.

Referring to FIG. 8, in the second sampling period SP2, the nth scan signal SC(n) is input as the on level ON, and the (n−1)th scan signal SC(n−1) and the nth emission signal EM(n) are input as the off level OFF. The second sampling period SP2 is for setting the second gate-source voltage Vgs2 of the driving TFT DT based on a data voltage Vx and another data voltage Vy (which is the data voltage applied to another pixel), in order to compensate for the hysteresis phenomenon of the driving TFT DT.

Figure 9E:
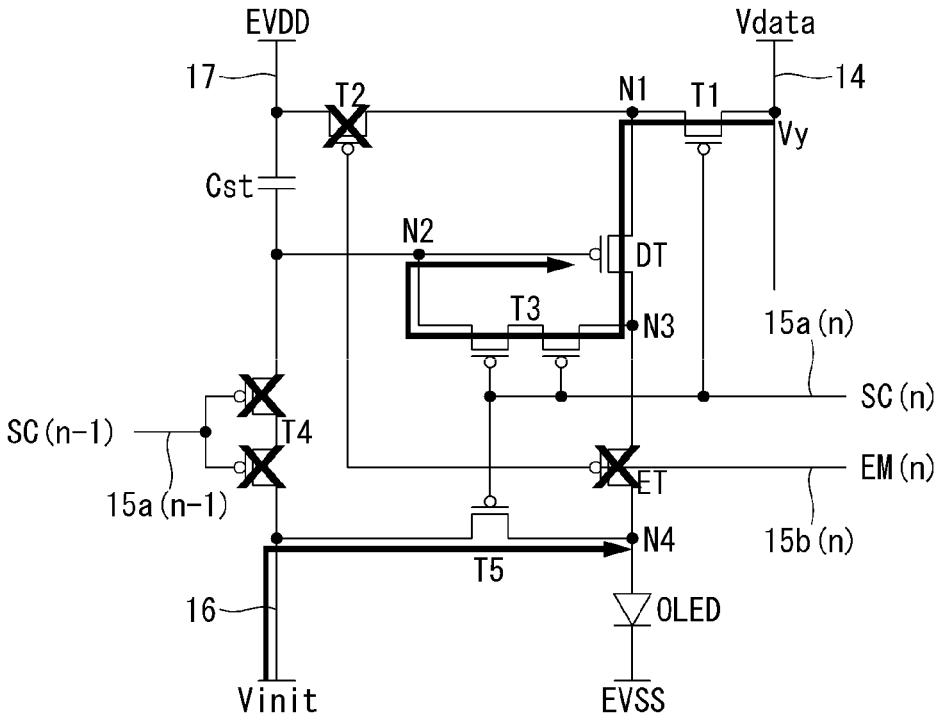
FIG. 9E is an equivalent circuit diagram showing the operation of the pixel during a second sampling period of FIG. 8.

Referring to FIG. 9E, during the second sampling period SP2, the first, third and fifth switching TFTs T1, T3 and T5 are turned on in response to the nth scan signal SC(n) of the on level ON. The potential of the first node N1 is changed intro a data voltage Vy owing to the turning on of the first switching TFT T1. And the gate electrode and the second electrode of the driving TFT DT are short-circuited by the turning on of the third switching TFT T3, so the driving TFT DT is diode-connected. If a current flows through the driving TFT DT with being diode-connected, the threshold voltage of the driving TFT DT is sampled and stored at the second node N2 and the third node N3. That is, the potential of the second node N2 and the third node N3 becomes (Vy−Vth). The gate-source voltage Vgs of the driving TFT DT is the voltage between the first node N1 and the second node N2. So, during the second sampling period SP2, the first gate-source voltage of the driving TFT DT gradually converges to the threshold voltage of the driving TFT DT. This voltage is different from the first gate-source voltage Vgs1 (EVDD−Vx+Vth) of the emission period EP described above and contributes to lowering the level of the hysteresis phenomenon of the driving TFT DT.

Referring to FIG. 9E, during the second sampling SP2, the fourth switching TFT T4 is turned off in response to the (n−1)th scan signal SC(n−1) of the off level OFF, and the second switching TFT T2 and the emission controlling TFT ET maintain their turn-off states in response to the nth emission signal EM(n) of the off level OFF.

As described above, according to the electroluminescent display device of the present disclosure, during the turning off period of an emission controlling element (e.g., an emission controlling TFT) within one frame, the on-biased state of a driving element (e.g., a driving TFT) is changed by applying, to a pixel, the data voltage input to another pixel in the multi-scan driving method. Since the time that the gate-source voltage of the driving element is maintained within one frame is reduced, the electroluminescent display device of the present disclosure may improve the level of the hysteresis phenomenon of the driving element and the DC afterimage included from the hysteresis phenomenon, thereby raising a display quality.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An electroluminescent display device, comprising:

a plurality of pixels, wherein each of the plurality of pixels comprises:

a driving element for generating a driving current, the driving element including a gate electrode and a source electrode;

a light emitting element for emitting light according to the driving current;

an emission controlling element for controlling a flow of the driving current between the driving element and the light emitting element by turning on or off the emission controlling element; and a switching circuit for setting a first gate-source voltage of the driving element and setting a second gate-source voltage of the driving element, the driving current being based on the gate-source voltage of the driving element, wherein one frame is divided into a first period and a second period, wherein the first period includes a first initializing period, a first sampling period following the first initializing period, and an emission period following the first sampling period, wherein the second period includes a second initializing period following the emission period and a second sampling period following the second initializing period, wherein the first gate-source voltage is the gate-source voltage of the driving element in the emission period and the second gate-source voltage is the gate source voltage of the driving element in the second sampling period, wherein the second gate-source voltage is different from the first gate-source voltage, and wherein during the second period the emission controlling element is turned off.

2. The electroluminescent display device of claim 1, wherein the second gate-source voltage is for changing the on-biased state of the driving element, and wherein the switching circuit sets the second gate-source voltage a plurality of times based on a plurality of data voltages during the second period.

3. The electroluminescent display device of claim 2, wherein the driving element becomes a first on-biased state by the first gate-source voltage and becomes a second on-biased state by the second gate-source voltage, and the first on-biased state and the second on-biased state are different from each other.

4. The electroluminescent display device of claim 2, wherein a data voltage is applied to another pixel during the second period, and a first gate-source voltage of a driving element included in the another pixel is set according to the data voltage.

5. The electroluminescent display device of claim 4, wherein during the emission controlling element is turned on within the first period, the light emitting element emits light by the driving current applied through the emission controlling element.

6. The electroluminescent display device of claim 1, further comprising:

a source driver for generating a first data voltage to supply to a data line connected to the plurality of pixels within the first period, and generating a second data voltage to supply the data line within the second period; and a gate driver for generating a first pulse of a first scan signal synchronized with the first data voltage to supply to a first gate line connected to the plurality of pixels within the first period, generating a second pulse of the first scan signal synchronized with the second data voltage to supply to the first gate line within the second period, and generating a first pulse of a second scan signal synchronized with the second data voltage to supply to a second gate line connected to the plurality of pixels within the second period.

7. The electroluminescent display device of claim 1, wherein the gate electrode, a first electrode and a second electrode of the driving element are respectively connected to a second node, a first node and a third node, wherein the emission controlling element is connected between the third node and a fourth node, wherein the light emitting element is connected between the fourth node and an input terminal of a low potential power voltage, and wherein the switching circuit is connected to the data line through which a first and second data voltages are supplied, a first power line through which an initializing voltage is supplied, and a second power line through which a high potential power voltage is supplied.

8. The electroluminescent display device of claim 7, wherein the switching circuit comprises:

a first switching element connected between the first node and the data line;

a second switching element connected between the first node and the second power line;

a third switching element connected to the second node and the third node;

a fourth switching element connected to the second node and the first power line;

a fifth switching element connected to the fourth node and the first power line; and a storage capacitor connected between the second power line and the second node.

9. The electroluminescent display device of claim 8, wherein the fourth switching element is switched according to an (n−1)th scan signal, wherein the first, third and fifth switching elements are switched according to an nth scan signal, the nth scan signal being later than the (n−1)th scan signal in their phases of an on period, wherein the emission controlling element and the second switching element are switched according to an nth emission signal, wherein the (n−1)th scan signal and the nth scan signal are respectively input as an on level in the first period and the second period sequentially, and wherein the nth emission signal is input as an off level in the first and second periods and is input as the on level in a third period between the first period and the second period.

10. A method of driving an electroluminescent display device equipped with a plurality of pixels, each of the plurality of pixels comprising a driving element for generating a driving current, wherein the driving element including a gate electrode and a source electrode, a light emitting element for emitting light according to the driving current and an emission controlling element for controlling a flow of the driving current between the driving element and the light emitting element, the method comprising:

setting a first gate-source voltage of the driving element; and setting a second gate-source voltage of the driving element, wherein one frame is divided into a first period and a second period, wherein the first period includes a first initializing period, a first sampling period following the first initializing period, and an emission period following the first sampling period, wherein the second period includes a second initializing period following the emission period and a second sampling period following the second initializing period, wherein the first gate-source voltage is the gate-source voltage of the driving element in the emission period and the second gate-source voltage is the gate source voltage of the driving element in the second sampling period, wherein the second gate-source voltage is different from the first gate-source voltage, and wherein during the second period the emission controlling element is turned off.

11. The method of claim 10, further comprising changing the second gate-source voltage for the on-biased state of the driving element to compensate a hysteresis phenomenon of the driving element, and wherein the setting the second gate-source voltage of the driving element includes setting the second gate-source voltage a plurality of times based on a plurality of data voltages during the second period.

12. The method of claim 11, wherein the driving element becomes a first on-biased state by the first gate-source voltage and becomes a second on-biased state by the second gate-source voltage, and the first on-biased state and the second on-biased state are different from each other.

13. The method of claim 12, further comprising applying a data voltage to another pixel during the second period, and setting the first gate-source voltage of the driving element included in the another pixel according to the data voltage.

14. The method of claim 13, wherein during the emission controlling element is turned on within the first period, emitting light at the light emitting element by the driving current applied through the emission controlling element.

15. The method of claim 10, further comprising:

generating a first data voltage to supply to a data line connected to the plurality of pixels within the first period, and generating a second data voltage to supply the data line within the second period;

generating a first pulse of a first scan signal synchronized with the first data voltage to supply to a first gate line connected to the plurality of pixels within the first period; and generating a second pulse of the first scan signal synchronized with the second data voltage to supply to the first gate line within the second period, and generating a first pulse of a second scan signal synchronized with the second data voltage to supply to a second gate line connected to the plurality of pixels within the second period.

* * * * *